US006029298A

United States Patent [19]

Dausch et al.

[11] Patent Number: 6,029,298

[45] Date of Patent: Feb. 29, 2000

[54] SYSTEM AND METHOD FOR DETERMINING A LIQUID LEVEL SETTING IN A WASHING MACHINE

[75] Inventors: Mark Edward Dausch, Latham; Vivek Venugopal Badami, Schenectady; Seth Alexander Capello, Watervliet, all of N.Y.

[73] Assignee: General Electric Company, Schenectady, N.Y.

[21] Appl. No.: 09/060,233

[22] Filed: Apr. 14, 1998

[51] Int. Cl.[7] ..... D06B 11/26

[52] U.S. Cl. ..... 8/159; 68/12.05; 68/12.21

[58] Field of Search ..... 8/158, 159; 69/12.02, 69/12.21, 12.05

[56] References Cited

U.S. PATENT DOCUMENTS

| | | | |
|---|---|---|---|
| 3,030,789 | 4/1962 | Rothenberger | 68/12.21 |
| 5,144,819 | 9/1992 | Hiyama et al. | 68/12.05 |
| 5,230,228 | 7/1993 | Nakano et al. | 68/12.05 |
| 5,285,545 | 2/1994 | Payne et al. | 8/159 |
| 5,577,283 | 11/1996 | Badami et al. . | |
| 5,669,095 | 9/1997 | Dausch et al. . | |
| 5,669,250 | 9/1997 | Dausch et al. . | |
| 5,737,790 | 4/1998 | Badger et al. | 8/158 |
| 5,768,728 | 6/1998 | Harwood et al. | 8/159 |

FOREIGN PATENT DOCUMENTS

| | | | |
|---|---|---|---|
| 1-201298 | 8/1989 | Japan | 68/12.21 |
| 2-255186 | 10/1990 | Japan | 68/12.21 |
| 2070648 | 9/1981 | United Kingdom | 68/12.05 |

*Primary Examiner*—Frankie L. Stinson
*Attorney, Agent, or Firm*—David C. Goldman; Jill M. Breedlove

[57] ABSTRACT

This invention provides a system and method for determining a level of liquid to be supplied for a wash cycle operation in a washing machine given a clothes load and clothes type. The liquid level setting is determined by measuring the time to fill the washer basket and the washer tub with a predetermined initial level of liquid, measuring a change in the level of liquid in the tub and basket after soaking for a predetermined time, and applying a fuzzy logic algorithm to the measured values.

11 Claims, 10 Drawing Sheets

IF FILL_TIME IS SHORT AND LEVEL_CHANGE IS SMALL THEN LIQUID_LEVEL IS SMALL;
IF FILL_TIME IS SHORT AND LEVEL_CHANGE IS MEDIUM THEN LIQUID_LEVEL IS MEDIUM;
IF FILL_TIME IS SHORT AND LEVEL_CHANGE IS LARGE THEN LIQUID_LEVEL IS MEDIUM;
IF FILL_TIME IS SHORT AND LEVEL_CHANGE IS VLARGE THEN LIQUID_LEVEL IS LARGE;
IF FILL_TIME IS MEDIUM AND LEVEL_CHANGE IS SMALL THEN LIQUID_LEVEL IS MEDIUM;
IF FILL_TIME IS MEDIUM AND LEVEL_CHANGE IS MEDIUM THEN LIQUID_LEVEL IS MEDIUM;
IF FILL_TIME IS MEDIUM AND LEVEL_CHANGE IS LARGE THEN LIQUID_LEVEL IS MEDIUM;
IF FILL_TIME IS MEDIUM AND LEVEL_CHANGE IS VLARGE THEN LIQUID_LEVEL IS LARGE;
IF FILL_TIME IS LONG AND LEVEL_CHANGE IS SMALL THEN LIQUID_LEVEL IS MEDIUM;
IF FILL_TIME IS LONG AND LEVEL_CHANGE IS MEDIUM THEN LIQUID_LEVEL IS MEDIUM;
IF FILL_TIME IS LONG AND LEVEL_CHANGE IS LARGE THEN LIQUID_LEVEL IS LARGE;
IF FILL_TIME IS LONG AND LEVEL_CHANGE IS VLARGE THEN LIQUID_LEVEL IS VLARGE;
IF FILL_TIME IS VLONG AND LEVEL_CHANGE IS SMALL THEN LIQUID_LEVEL IS LARGE;
IF FILL_TIME IS VLONG AND LEVEL_CHANGE IS MEDIUM THEN LIQUID_LEVEL IS LARGE;
IF FILL_TIME IS VLONG AND LEVEL_CHANGE IS LARGE THEN LIQUID_LEVEL IS VLARGE;
IF FILL_TIME IS VLONG AND LEVEL_CHANGE IS VLARGE THEN LIQUID_LEVEL IS VLARGE;

FIG. 5

| | | SMALL | MEDIUM | LARGE | VLARGE |
|---|---|---|---|---|---|
| FILL TIME | SHORT | SMALL | MEDIUM | MEDIUM | LARGE |
| | MEDIUM | MEDIUM | MEDIUM | MEDIUM | LARGE |
| | LONG | MEDIUM | MEDIUM | LARGE | VLARGE |
| | VLONG | LARGE | LARGE | VLARGE | VLARGE |

FIG. 6

SYSTEM AND METHOD FOR DETERMINING A LIQUID LEVEL SETTING IN A WASHING MACHINE

FIELD OF THE INVENTION

This invention relates generally to a washing machine for cleansing clothes and similar articles and more particularly to a washing machine that determines a liquid level setting for a wash cycle operation for a given load and fabric type.

BACKGROUND OF THE INVENTION

Typically, during a normal operation of a washing machine, a user loads articles to be cleansed into a washer basket, selects a wash cycle, and starts the machine. The washing machine then performs a number of operations to complete the wash cycle. Generally, the wash cycle includes a wash operation, a spin operation, a rinse operation and a spin operation. The wash operation includes filling the washer basket and a washer tub which contains the basket with water to a user selected level. An agitator disposed in the washer basket then imparts an oscillatory motion to the water and detergent (wash liquid) and the articles. The oscillatory motion causes the articles and wash liquid to move back and forth in the washer basket. This movement provides mechanical energy which is used to assist in removing soils from the articles. After agitating the articles and wash liquid for a predetermined length of time, the liquid is then pumped out of the washer basket and washer tub. Generally, this is followed by a spin operation to reduce the remaining wash liquid. The rinse operation is similar to the wash operation in that it includes filling the washer basket and the washer tub to a previously assigned level, agitating for a predetermined amount of time, and pumping the wash liquid out of the basket and tub. Typically, the wash cycle includes one wash operation and one rinse operation, but most washing machines provide an optional extra rinse operation to further remove any remaining detergent. Once a majority of the wash liquid has been removed by the rinse operation, the spin operation is activated to extract additional liquid from the articles. During the spin operation, the washer basket rotates in one direction at a high angular velocity. This rotation creates a centrifugal force on the articles and the wash liquid causing excess liquid to exit or be extracted through perforations in the washer basket wall.

In order for the wash cycle to effectively clean the articles, it is necessary to ensure that the washer basket and washer tub are filled with an adequate amount of water for agitation. If the amount of water provided is too low, then the articles might not have enough water to effectively clean the articles. In addition, too low of a water level will result in a large amount of mechanical stress on the agitator and its drive system. Furthermore, if there is a low level of water, then the articles cannot move as well which increases the possibility of damage to the articles. On the other hand, if too much water is added, then some of the articles will float in the washer basket and not receive enough interfacial wash action from the agitator to effectively clean the articles. Too much water is also energy inefficient because water is being wasted along with energy expended to heat, pump, and agitate the extra water. Another problem with adding too much water is that the agitator will not be able to impart the proper amount of back and forth motion to the articles for optimal cleaning or rinsing.

One approach that has been used to overcome the above problems is to automatically control the amount of water added to the washer basket and washer tub during a wash cycle. This approach generally uses the weight of the articles to be cleansed as a factor in determining the amount of water to be added. Determining the weight of the articles has been achieved by typically measuring the torque on the agitator and drive system and then determining the inertia of the articles in the washer basket. Measuring the torque on the agitator and drive system and determining the inertia of the articles requires complex and expensive equipment. Using weight sensors to determine the weight of the articles is another approach that has been used. However, weight sensors are expensive and have to be continually calibrated. Accordingly, there is a need to be able to determine the weight of the articles without having to rely on complex and expensive equipment so that the amount of water added to the washer basket and washer tub during a wash cycle can be automatically controlled.

SUMMARY OF THE INVENTION

This invention is able to automatically control the amount of water added to the washer basket and washer tub by sensing an initial level of water added to the basket and tub and applying a fuzzy logic based algorithm to determine a level of water to be added to the basket and tub during a wash cycle operation. Thus, the amount of water added to the washer basket and washer tub during a wash cycle operation can be automatically controlled for the size of a given clothes load and clothes type without having to use complex and expensive equipment.

In accordance with a first embodiment of this invention, there is disclosed a washing machine for cleansing articles. The washing machine comprises a washer tub and a washer basket disposed in the washer tub for receiving the articles. A liquid supply source supplies a liquid to the washer tub and washer basket. A timer measures the time to fill the washer tub and the washer basket with a predetermined initial level of liquid and provides a signal representation thereof. A liquid level sensor measures a change in the level of liquid in the washer tub and washer basket after waiting a predetermined time and provides a signal representation thereof. A controller, responsive to the timer and the liquid level sensor, determines a level of liquid to be supplied to the washer tub and the washer basket by the liquid supply source for a wash cycle operation of the washing machine as a function of the time and the change in liquid level.

In accordance with a second embodiment of this invention there is disclosed a method for determining a level of liquid to be supplied in a wash cycle operation of a washing machine having a washer tub and a washer basket disposed in the washer tub with articles contained therein. In this method a liquid is supplied to the washer tub and the washer basket. The washer tub and the washer basket is filled with the liquid to a predetermined initial level. The time to fill the washer tub and the washer basket to the predetermined initial level is measured and a signal representation thereof is provided. The articles in the washer basket are soaked for a predetermined time. A change in the level of liquid in the washer tub and washer basket after soaking for the predetermined time is measured and a signal representation thereof is provided. The level of liquid to be supplied for the wash cycle operation is determined as a function of the time to fill to the predetermined initial level and the change in the level of liquid.

DESCRIPTION OF THE DRAWINGS

FIG. 5 shows the fuzzy rules used by the fuzzy logic system according to this invention;

FIG. 6 shows a rule table incorporating the fuzzy rules of FIG. 5;

DETAILED DESCRIPTION OF THE INVENTION

Figure 1:
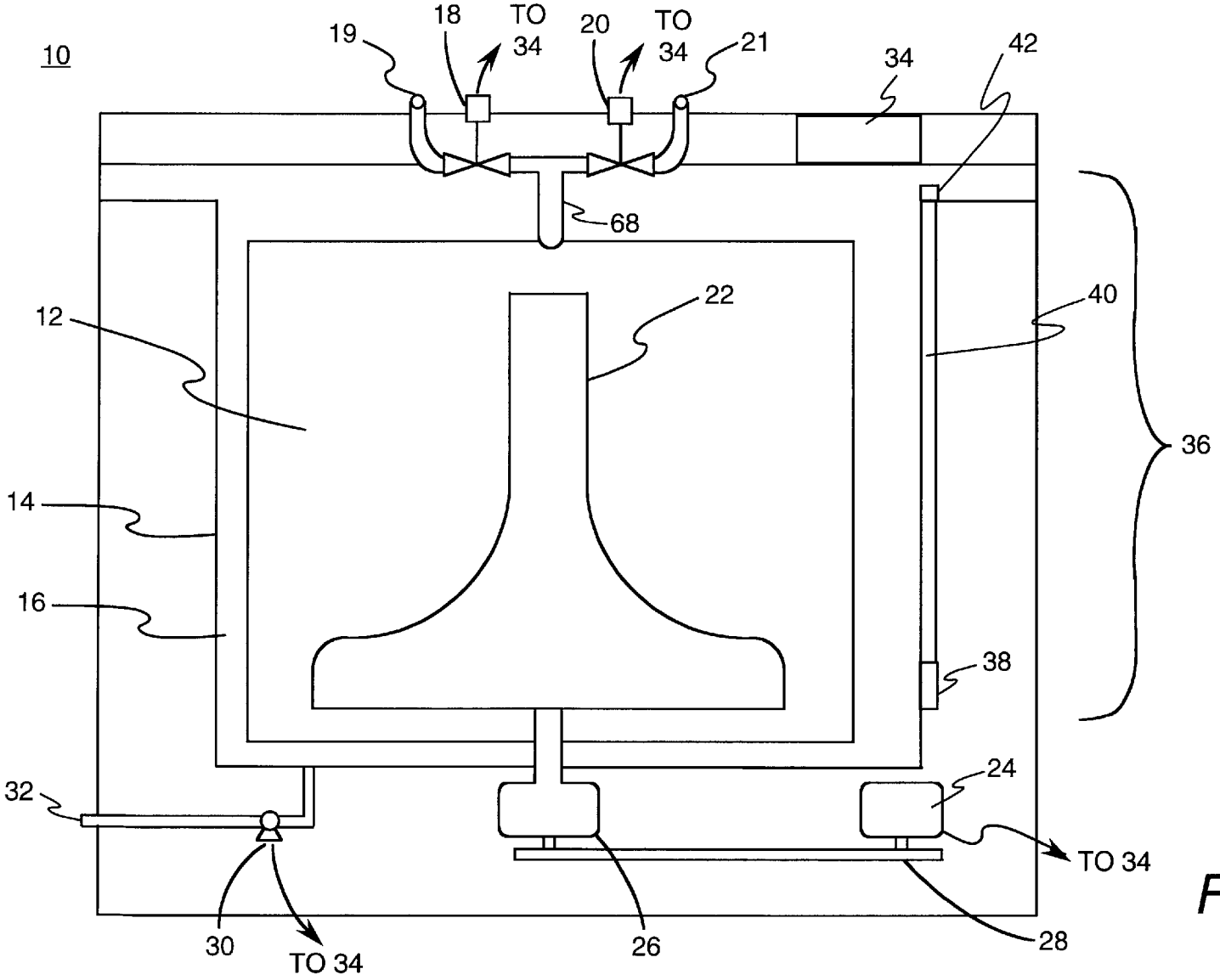
FIG. 1 shows a front elevational view of a portion of a washing machine according to this invention with its front panel removed.

FIG. 1 shows a front elevational view of a portion of a washing machine 10 according to this invention with its front panel removed. The washing machine 10 includes a washer basket 12 for receiving clothing and other articles to be cleansed. The washer basket 12 is movably disposed in a washer tub 14. The washer basket 12 is separated from the washer tub 14 by an annulus 16. The washer basket 12 preferably has perforations throughout its wall to allow fluid communication between the interior of the basket and the washer tub 14. A hot liquid valve 18 and a cold liquid valve 20 provide water or other washing liquid to the washer basket 12 and the washer tub 14 through a hot liquid hose 19 and a cold liquid hose 21, respectively. The liquid valves and the liquid hoses comprise the washing machine's liquid supply source. Both the hot liquid hose 19 and the cold liquid hose 21 are connected to a liquid inlet tube which provides liquid to the washer basket 12 and the washer tub 14 through a spray fill conduit. Along the length of the spray fill conduit are openings arranged in a predetermined manner to direct incoming streams of water in a downward tangential direction towards articles in the washer basket 12. The openings are located at a predetermined distance apart from each other such that there is an overlapping coverage of liquid streams. This arrangement allows the load of articles to be uniformly wetted. A more detailed discussion of the spray fill conduit is set forth in commonly assigned, co-pending U.S. patent application Ser. No. 060,234 (Attorney Docket No. RD-25,854), entitled "Device For Providing Uniform Wetting Of Articles In A Washing Machine", filed concurrently herewith, which is incorporated herein by reference.

An agitator 22 is disposed in the washer basket 12 to impart an oscillatory motion to the articles and the liquid in the basket. In FIG. 1, the washer basket 12 and the agitator 22 are oriented to rotate about a vertical axis. Although this invention is described with reference to a vertical axis washing machine, the features of this invention may be used with a horizontal axis washing machine. The washer basket 12 and the agitator 22 are driven by a motor 24. The back and forth motion imparted by the agitator is transmitted by a transmission 26 which is coupled to the motor 24 by a pulley, brake, and clutch system 28. The motor 24, the transmission 26, and the pulley, brake and clutch system 28 comprise the washing machine's drive system. A pump 30 pumps liquid out of the washer basket 12, the washer tub 14 and annulus 16 through a drain hose 32.

The operation of the washing machine 10 is controlled by a controller 34 which has a user interface that allows the user to select a wash cycle for washing a given type of articles and to start the machine. In response to the user selection, the controller 34 turns on the hot liquid valve 18 and/or the cold liquid valve 20 to fill the washer basket 12 and the washer tub 14 with liquid to a predetermined initial level. In this invention, the predetermined initial level of liquid is preferably 4 inches (10.16 cm) as measured from the bottom of the washer basket 12, however, other initial levels of liquid can be used. After the liquid reaches the predetermined initial level, the controller 34 measures the time that it takes for the liquid to reach the initial level. The controller 34 then records the elapsed time and shuts off the liquid valves.

The articles soak in the washer basket 12 for a predetermined amount of time. In this invention, the predetermined amount of time for soaking the articles is preferably in the range of about 15 seconds to 20 seconds, however, other ranges of time can be used. During this soaking period, the articles absorb a percentage of the liquid, the washer basket 12 retains a percentage of the liquid, and the remaining percentage of liquid flows from the basket to the annulus 16. A liquid level sensor 36 measures the change in the liquid level in the washer tub 14 after the soak period has elapsed and provides a signal representative thereof to the controller 34. In this invention, the liquid level sensor 36 includes a reservoir 38 integrally formed in the washer tub 14. Once the liquid in the washer tub 14 reaches above the opening of the reservoir 38 air becomes trapped in the reservoir and cannot escape. The trapped air creates a pressure differential in a capillary tube 40 that is attached to the reservoir 38. The pressure differential in the capillary tube 40 corresponds to the height of the liquid in the annulus 16 above the opening of the reservoir 38. A pressure sensor 42 measures the pressure differential in the capillary tube and sends a signal thereof to the controller 34.

Figure 2:
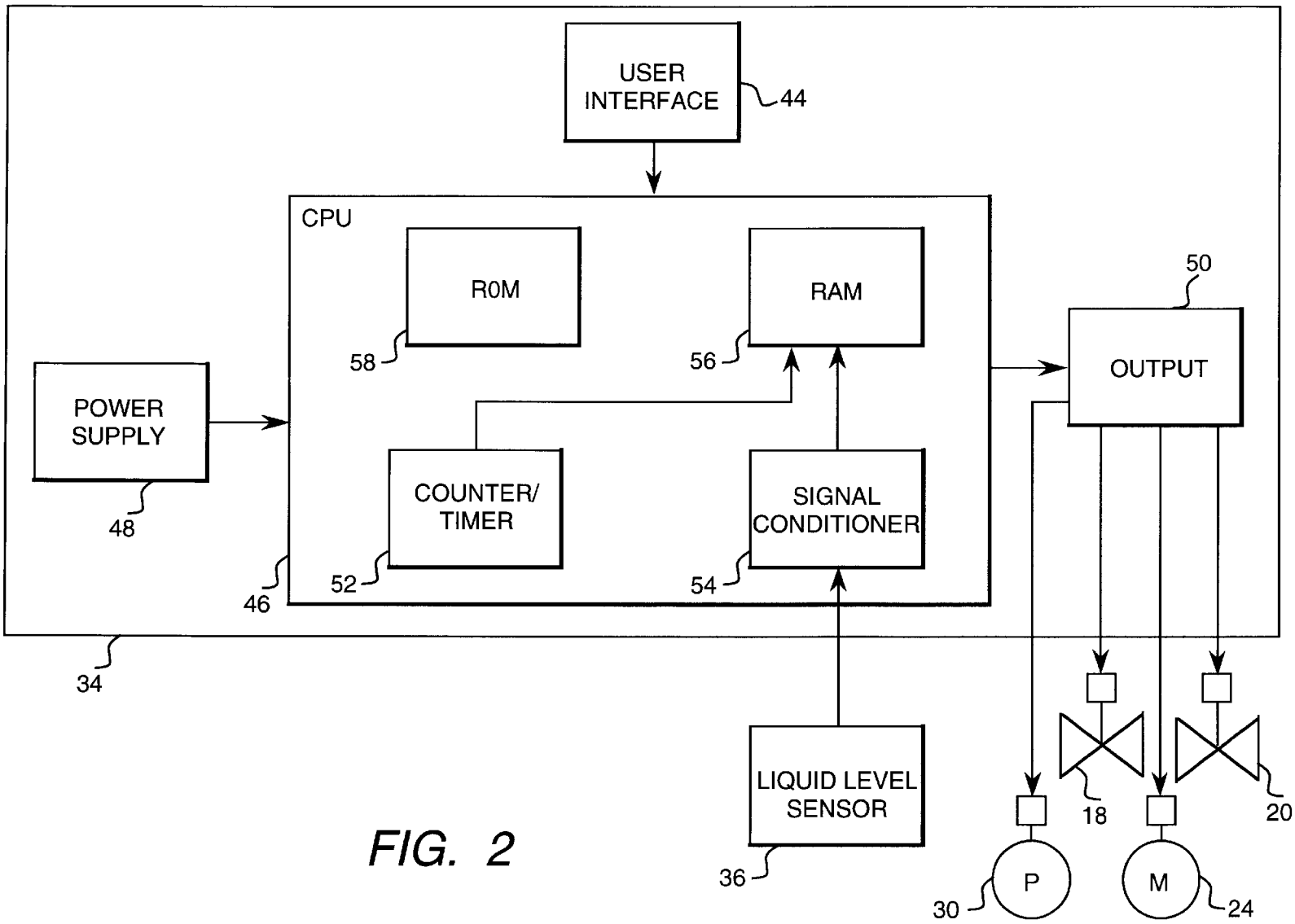
FIG. 2 shows a more detailed view of the controller shown in FIG. 1 according to this invention.

A more detailed view of the controller 34 according to this invention is shown in FIG. 2. The controller 34 comprises a user interface 44 that allows the user to select a wash cycle for washing a particular type of articles and to start the washing machine 10. A central processing unit (CPU) 46 which receives power from a power supply 48 initializes the washing machine 10 and sends signals to an output circuit 50. The output circuit 50 instructs the hot liquid valve 18 and/or the cold liquid valve 20 to fill the washer basket 12 and washer tub 14 with liquid up to the predetermined initial level. A counter/timer 52 measures the time that it takes to fill the washer basket 12 and washer tub 14 to the predetermined initial level. After the predetermined initial level has been reached, the CPU 46 sends a signal to the output circuit 50 to turn the hot liquid valve 18 and/or the cold liquid valve 20 off. The articles soak for the predetermined amount of time which is counted by the counter/timer 52. After the predetermined amount of time has elapsed, then the liquid level sensor 36 measures the change in the liquid level. The liquid level sensor 36 outputs a signal representative of the change in the liquid level to a signal conditioner 54. The values from the counter/timer 50 and the signal conditioner 54 are both stored in a random access memory (RAM) 56. The CPU 46 accesses the values stored in the RAM 56 and uses a fuzzy logic algorithm stored in a read only memory (ROM) 58 to determine a level of liquid to be supplied for a wash cycle operation. After the level of liquid has been determined, then the CPU 46 sends a signal to the output circuit 50 to turn on the hot liquid valve 18 and/or the cold liquid valve 20 and fill the washer basket 12 and washer tub 14 to the determined level.

Figure 3:
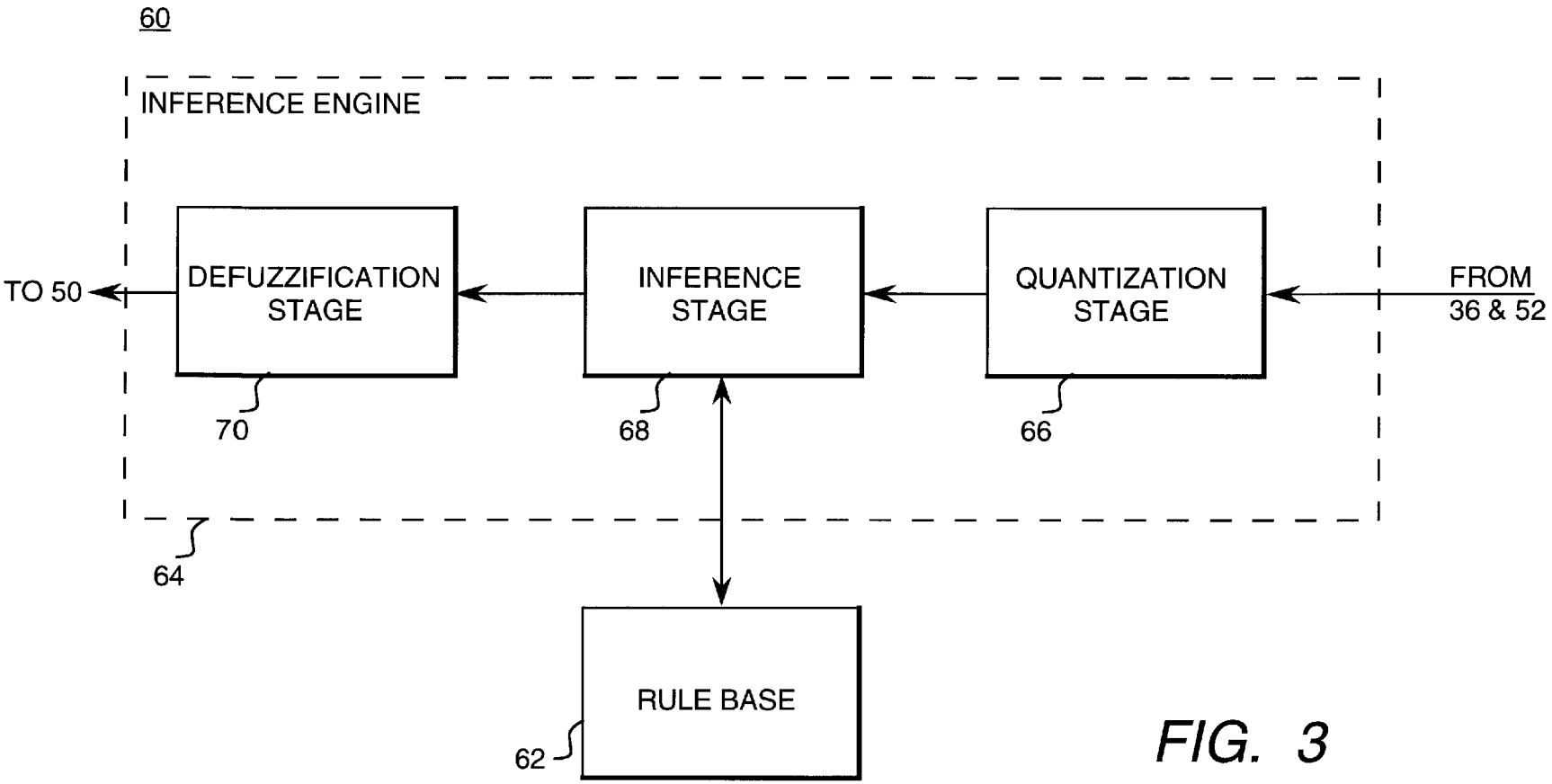
FIG. 3 shows a block diagram of a more detailed view of a fuzzy logic system that is used in this invention to determine a level of liquid to be supplied for a wash cycle operation.

As mentioned above, the fuzzy logic algorithm stored in the ROM 58 is used to determine the level of liquid to be supplied in a wash cycle operation. The fuzzy logic algorithm is essentially a fuzzy logic decision system 60, however, other types of decision systems such as a linear system or a non-linear system is within the scope of this invention. A more detailed view of the fuzzy logic decision system 60 is shown in FIG. 3. The fuzzy logic decision system 60 includes a rule base 62 having a set of fuzzy rules that are used in conjunction with an interpreter 64. The interpreter 64 includes a quantization stage 66, an inference stage 68, and a defuzzification stage 70. In the fuzzy logic decision system, the quantization stage 66 receives inputs from the liquid level sensor 36 and the counter/timer 52. The quantization stage 66 takes these inputs and makes them dimensionally compatible with the rules in the rule base 62. The inference stage 68 matches each of the rules in the fuzzy rule base 62 to the input values from the liquid level sensor 36 and the counter/timer 52. Also, the inference stage aggregates the rules that were found to have a partial match and generates an output value representative of the liquid level setting for the wash cycle operation. The defuzzification stage 70 uses a maximum dot centroid method to summarize the output value into a number which is then used by the CPU 46 to control the hot liquid valve 18 and the cold liquid valve 20. Those skilled in the art will realize that there are many design choices which can be made in the implementation of a fuzzy logic system, and the present invention is not limited to the above implementation.

Figure 4A:
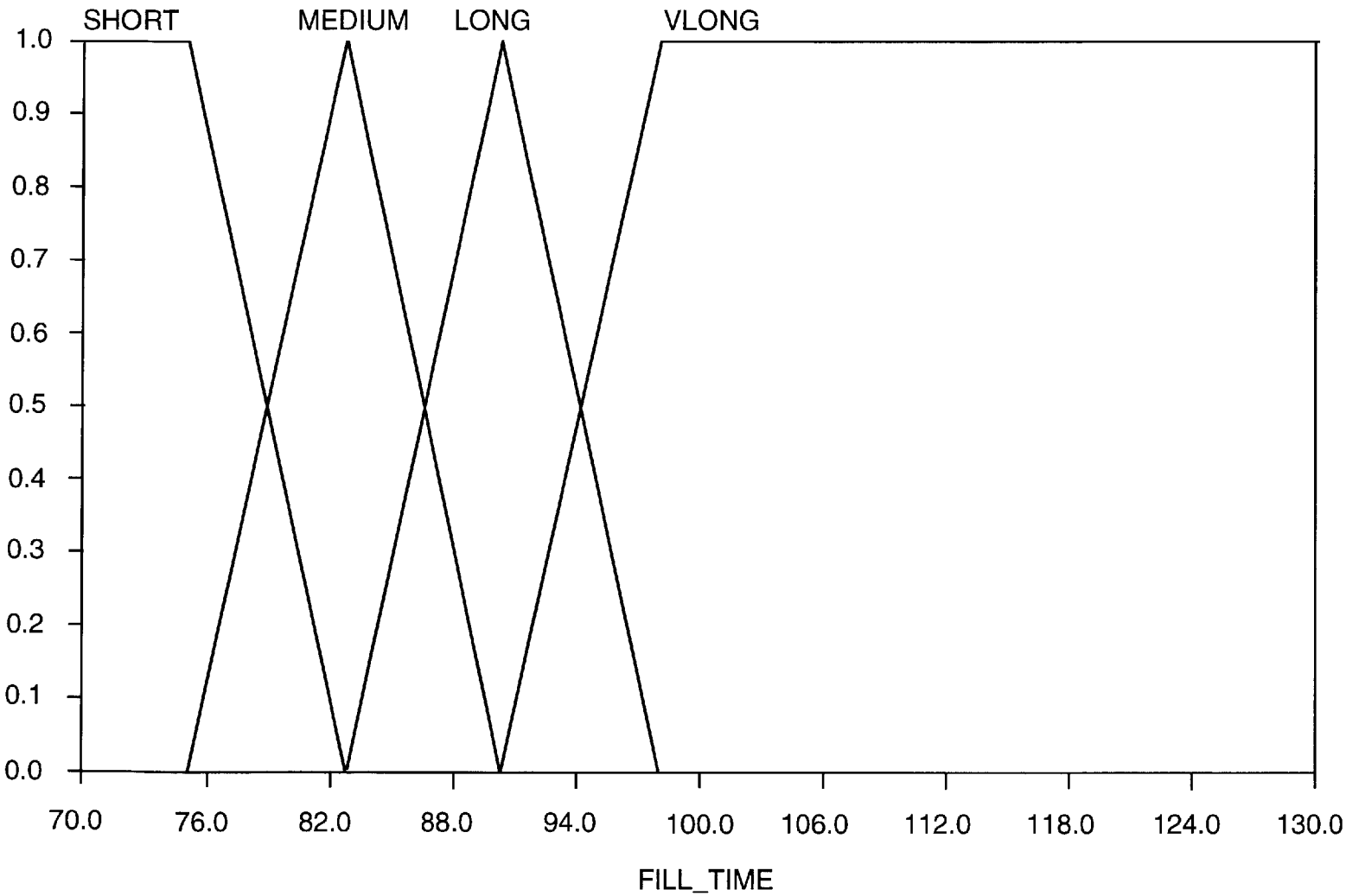
FIGS. 4*a*–4*c* shows the fuzzy set variables and values used by the fuzzy logic system according to this invention.
Figure 4B:
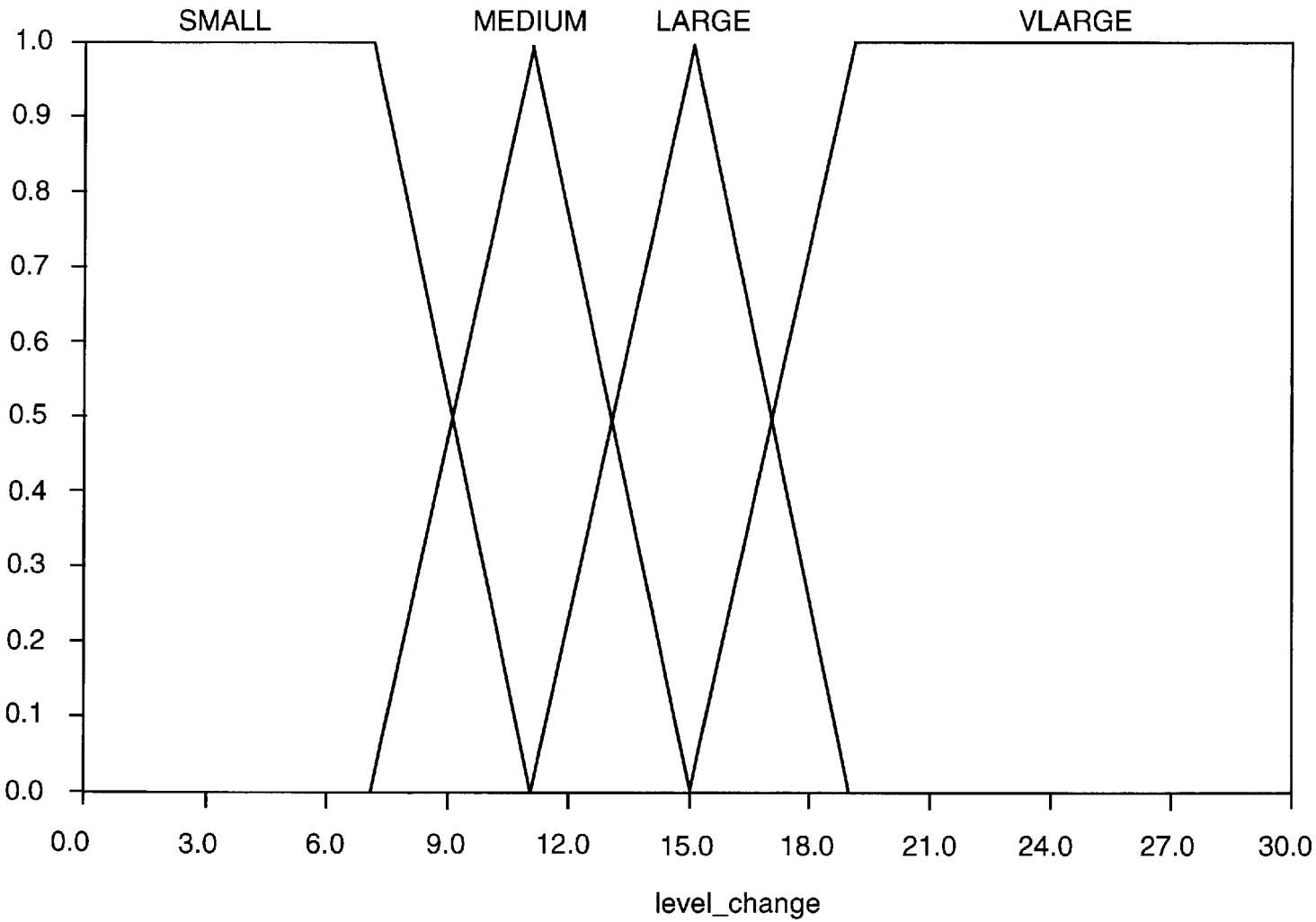
Figure 4C:
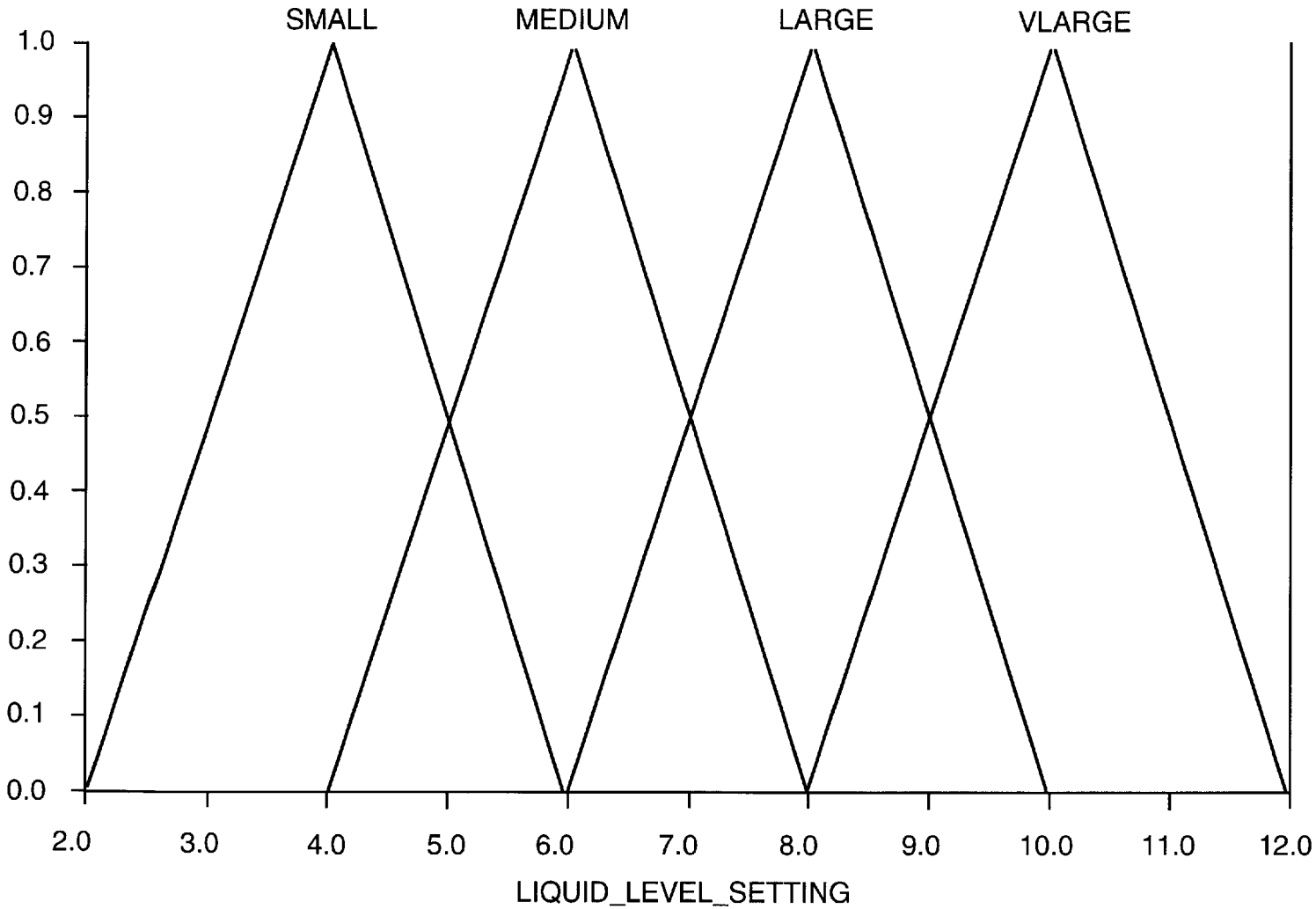

In the fuzzy logic decision system 60, the variables are the fill time to reach the predetermined initial liquid level, the level change in the liquid level, and the liquid level setting. The fuzzy sets for the variables and their respective membership values are shown in FIGS. 4*a*–4*c*. FIG. 4*a* shows the fuzzy sets and membership values for the fill time variable. The fill time variable has sets separated into short, medium, long, and very long. FIG. 4*b* shows the fuzzy sets and membership values for the level change variable. In particular, the level change variable has sets separated into small, medium, large, and very large (vlarge). FIG. 4*c* shows the fuzzy sets and membership values for the liquid level setting. In particular, the liquid level setting variable has sets separated into small, medium, large, and very large (vlarge). Note that each fuzzy set has a corresponding membership function that returns the degree of membership or belief, for a given value of the variable. Membership functions may be of any form, as long as the value that is returned is in the range of [0,1]. For example, in the preferred embodiment, if the fill time variable has a value ranging from 70.0 to 75.0, then it fits 100% into the short fuzzy set. If the fill time variable has a value ranging from 75.0 to 83.0, then the value will have a degree of membership in the short and medium fuzzy sets. If the fill time variable has a value ranging from 83.0 to 92, then the value will have a degree of membership in the medium and the long fuzzy sets. If the fill time variable has a value ranging from 92 to 98, then the value will have a degree of membership in the long and very long fuzzy sets. If the fill time variable has a value greater than 98, then it fits 100% into the very long fuzzy set. The other variables (i.e., level change and liquid level setting) have similar regions of overlap between their respective fuzzy set values as well as membership functions that return values in varying ranges.

The fuzzy sets associate the input variable values for the fill time and level change to the output variable value for the liquid level setting. The association is attained by the fuzzy rules stored in the rule base 62. The fuzzy rules comprise one or more antecedents and a conclusion comprising one or more consequences. FIG. 5 shows the fuzzy rules used according to this invention. An example of one rule is:

If (fill time is medium) AND (level change is large) THEN liquid level is medium In this example, the antecedents are If (fill time is medium) AND (level change is large). If the antecedents are met, then the conclusion for the liquid level setting is medium. A collection of these rules make up the fuzzy logic system 60 which takes inputs and produces outputs depending on which rules are fired. In the fuzzy logic system, a rule will fire if its premise evaluates a non-zero belief level. When a rule fires, it contributes to the output of the fuzzy logic system. The rules in a fuzzy logic system fire to different degrees. Rather than an all or nothing response, the fuzzy rules produce "shades of gray" responses, depending on the degree of belief in the premise of each rule. In addition, more than one rule may fire for a given group of inputs, so the output of the fuzzy logic system may be the combined result of several rules.

Figure 7A:
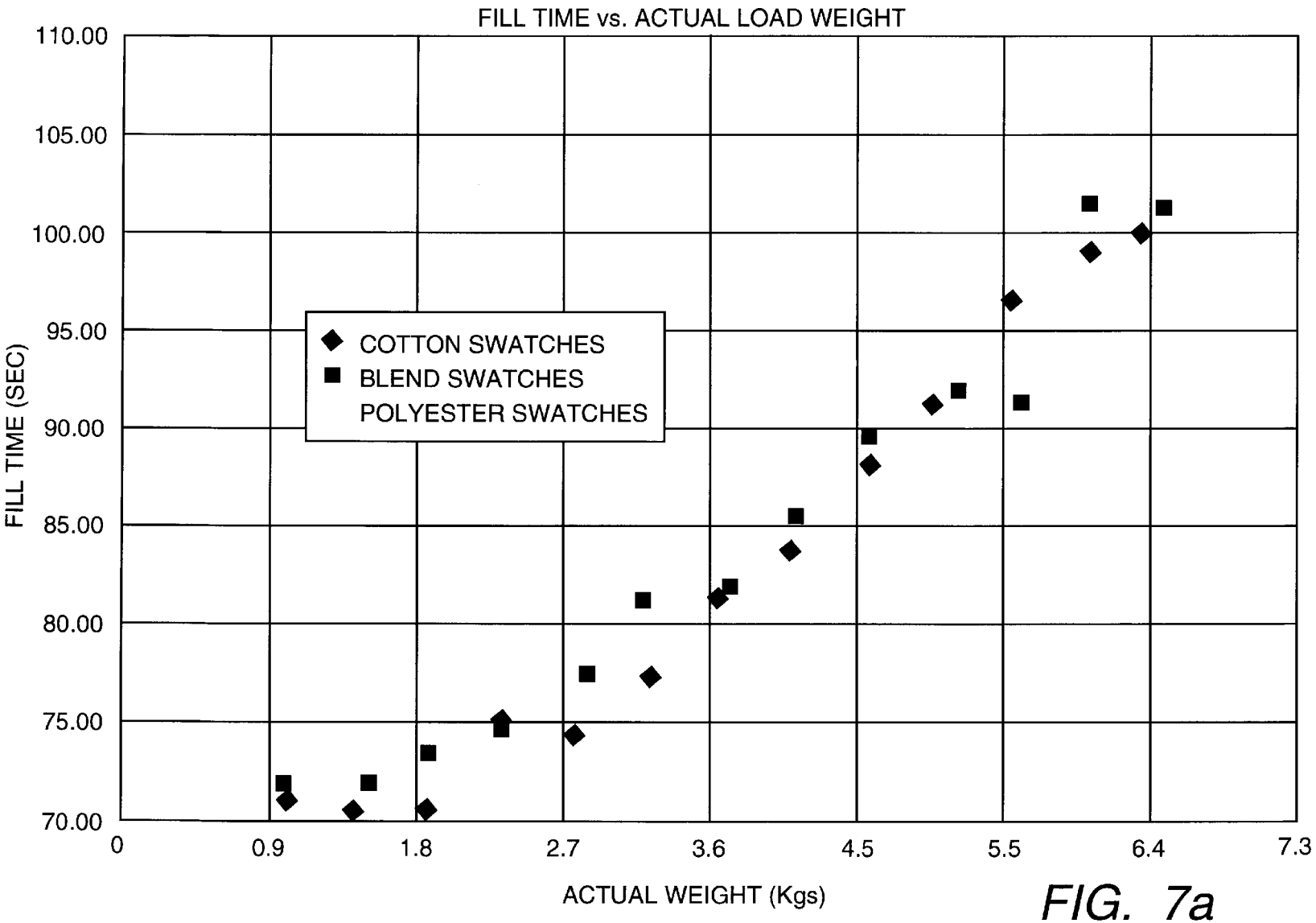
FIGS. 7*a*–7*b* are examples of plots showing the relationship between the fill time and the actual load weight and the relationship between the liquid level change and the actual load weight, respectively.

These fuzzy rules and their relationship between the input variables and the output variables are shown in tabular form in the rule table of FIG. 6. This rule table indicates what the liquid level setting value will be for the output variable for a particular input value for the fill time and level change variables. For example, if the fill time variable value is vlong and the level change variable value is medium, then the liquid level variable value will be large. Another example is if the fill time variable value is short and the level change variable value is large, then the liquid level variable value will be medium. Generally, as the washer basket 12 is filling to the predetermined initial level, the articles absorb a percentage of the liquid, the basket retains a percentage of the liquid and the remaining percentage of the liquid flows from the basket into the annulus 16. Cotton type articles hold more liquid than blends and blends hold more liquid than synthetic materials such as polyester. Therefore, the fill time is proportional to the mass of the articles and the fabric type. An example of this relationship is shown FIG. 7*a*. In particular, this plot shot shows the relationship between the fill time and the actual load weight for filling the washer basket containing cotton swatches and blend swatches with 4 inches (10.16 cm) of liquid.

Figure 7B:
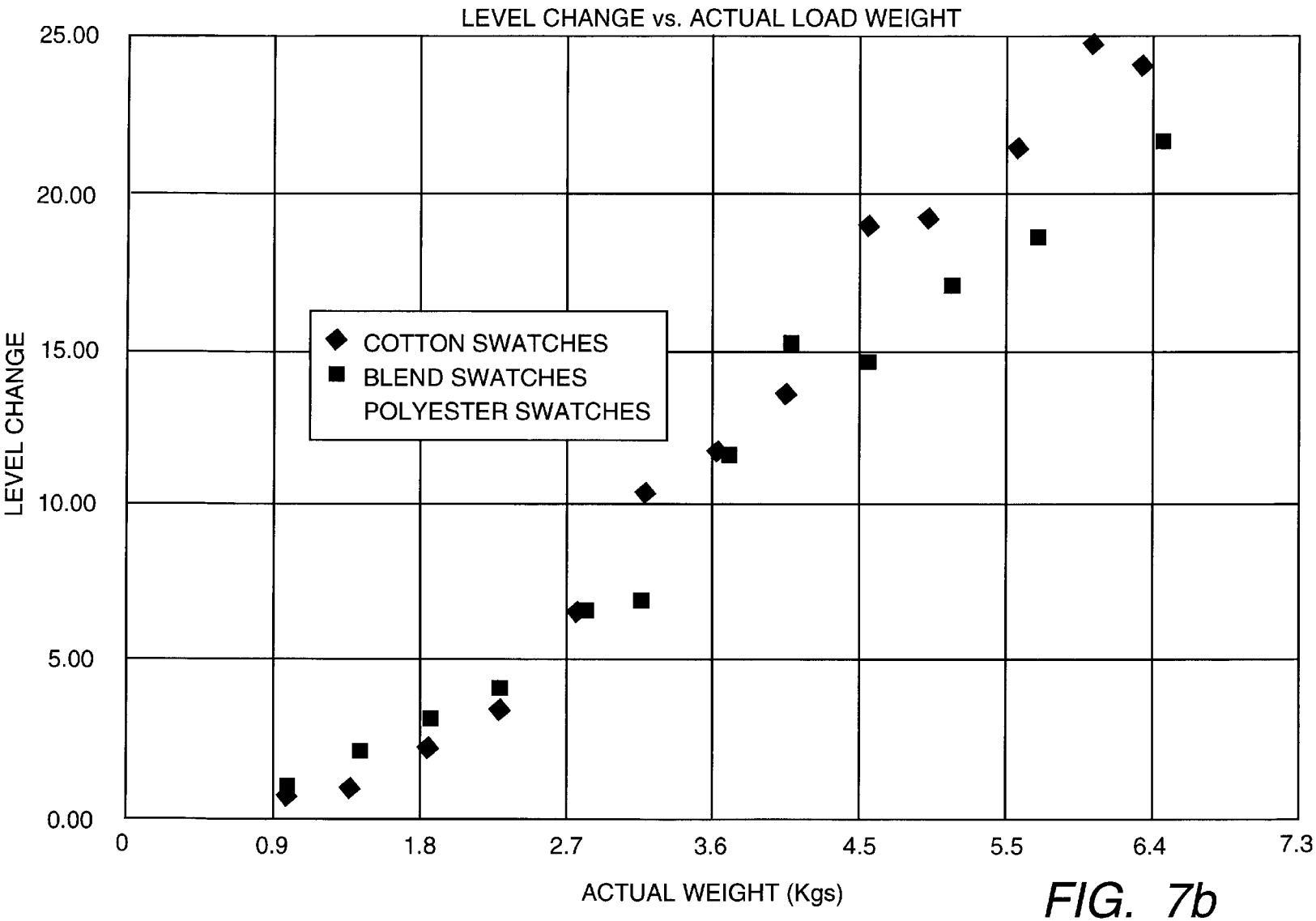

As far as the level change variable is concerned, the articles restrict the flow of liquid from the washer basket 12 to the annulus 16 because the perforations in the wall of the basket are covered by the clothing. A larger load will impede the flow more than a smaller load. This creates a hydrostatic pressure differential between the washer basket 12 and the annulus 16. During the soak period the liquid level height in the annulus 16 changes by an amount that is proportional to the height of the liquid in the washer basket 12 and the load size. Thus, a small fill time and small liquid level change increase the likelihood that the level of liquid for the wash cycle operation will be small, while a large fill time and a large liquid level change increase the likelihood that the level of liquid for the next machine operation will be larger to wash the articles in order to prevent undue stress to the agitator 22 and the articles, as well as to not waste liquid. FIG. 7*b* shows example of the relationship between liquid level change and the actual load weight. In particular, this plot shot shows the amount at which the liquid level changes in 20 seconds when the liquid is turned off after reaching 4 inches (10.16 cm). In this example, the liquid level change is scaled by a factor of 20.

When a fuzzy rule fires, it fires to a certain degree depending on the belief level in each antecedent in the premise of the rule. The antecedents are evaluated using membership functions to produce belief levels, which are then combined using fuzzy operators to produce the final output activation level. Finally, the output activation level is used to either scale or clip the fuzzy output set. Clipping the output is called Max-Min inference and scaling the output is called Max-Dot inference. The higher activation level for a rule, the more it will contribute to the combined output of all the rules. Once all of the fuzzy output sets have been computed, they are summed or unioned together to produce the combined fuzzy output set. As mentioned earlier, the Max-Dot/Centroid inference is the preferred defuzzification technique used in the defuzzification stage 70. The Max-Dot/Centroid inference defuzzification technique uses the following equation to compute the final value for the output variable:

$$\text{Output} = \frac{\sum_{i=1}^{n} \alpha_i M_i W_i}{\sum_{i=1}^{n} \alpha_i A_i W_i}, \tag{1}$$

wherein $a_i$ is the rule applicability, $M_i$ is the moment of the membership function, $W_i$ is the weight assigned to rule i, and $A_i$ is the area of the membership function. Other well known defuzzification methods such as Max-Min, Mean of Maxima, and Height Method, can also be used to perform evaluation and defuzzification. The CPU 46 in the controller 34 then uses the output value to turn on the hot liquid valve 18 and/or the cold liquid valve 20 and fill the washer basket 12 and washer tub 14 to the determined liquid level setting.

Figure 8:
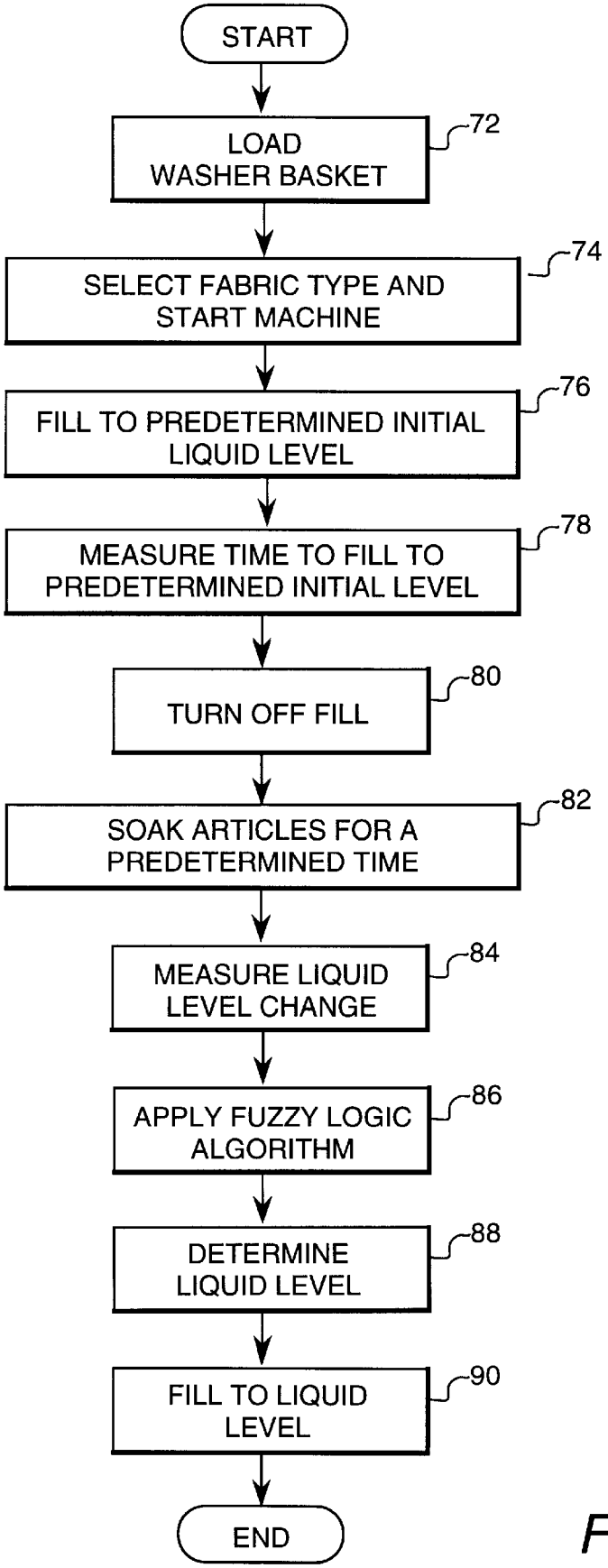
FIG. 8 shows a flow chart setting forth the steps used to determine a level of liquid to be supplied in a wash cycle operation according to this invention.

FIG. 8 is a flow chart setting forth the steps used in this invention to determine a liquid level setting to be supplied for a wash cycle operation of the washing machine 10 for a given load and fabric type. In this invention, the user loads the washer basket 12 with articles to be wash at 72. The user then selects a fabric type for the articles that are to be washed and starts the washing machine at 74. In response to the user selection, the controller 34 turns on the hot liquid valve 18 and/or the cold water valve 20 and fills the washer basket 12 and the washer tub 14 with a predetermined initial level of liquid at 76. The controller 34 measures the time that it takes for the liquid to reach the predetermined initial level at 78. After the liquid reaches the predetermined initial level, the controller shuts off the hot liquid valve 18 and/or the cold liquid valve 20 at 80 and records the elapsed time. The articles soak in the washer basket 12 for a predetermined amount of time at 82. After the soaking period has elapsed, the liquid level sensor 36 measures the change in the liquid level in the washer tub at 84. The fill time and the level change measurements are then applied to the fuzzy logic system at 86. The fuzzy logic system then determines the liquid level setting for the wash cycle operation at 88. The controller 34 then turns on the hot liquid valve 18 and/or the cold liquid valve 20 and fills the washer basket 12 and washer tub 14 to the determined liquid level at 90. After filling to the determined liquid level the washing machine is ready to begin the wash operation. Once the wash operation is completed then the rinse and spin operations are undertaken. Optimal fill levels for the rinse operations can be generated in the same fashion; alternatively, the rinse level can be the same as the fill level in the wash operation or some predetermined portion of the wash operation fill level.

It is also within the scope of this invention to use the determined liquid level setting as the starting level for an adaptive water level controller that monitors the load signature of the agitator during agitation cycles. For example, in this scenario, the adaptive controller would fill the washer basket and washer tub with the starting level of liquid. Then the adaptive water controller would generate signals to drive the motor to operate the agitator in one or more agitation cycles. Agitator load signature information (such as drive motor phase angle information) from the drive system during these agitation cycles is processed in an agitator work-determining processor to generate a control signal to stop the addition of liquid when the machine has been filled to the optimal level for that load of articles to be washed. In this example, the work-determining processor accomplishes this task by generating average phase angle information relating to respective agitation cycles and generating the derivative of the sequential average phase angle information. A more detailed discussion on an adaptive water controller that monitors the load signature of an agitator in order to provide an optimal fill level for a particular load of articles is set forth in U.S. Pat. No. 5,669,095, which is incorporated by herein by reference.

It is therefore apparent that there has been provided in accordance with the present invention, a system and method for determining a liquid level setting in a washing machine that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

We claim:

1. A washing machine for cleansing articles, comprising:

a washer tub;

a washer basket disposed in said washer tub for receiving the articles;

a liquid supply source for supplying a liquid to said washer tub and said washer basket;

a timer for measuring the time to fill said washer tub and said washer basket with a predetermined initial liquid level and providing a signal representation thereof;

a liquid level sensor, for measuring a change in the level of liquid in said washer tub and said washer basket after waiting a predetermined time and providing a signal representation thereof; and a controller, responsive to said timer and said liquid level sensor, for determining a level of liquid to be supplied to said washer tub and said washer basket by said liquid supply source for a wash cycle operation of said washing machine as a function of the time and the change in liquid level.

2. The washing machine according to claim 1, wherein said controller includes a fuzzy logic decision system comprising a fuzzy rule base fired as input values from said timer and said liquid level sensor are received, said fuzzy logic decision system matching the rules in said fuzzy rule base to the input values, and outputting an output value representative of the liquid level, said controller being operative to instruct said liquid supply source to supply the liquid to said washer tub and said washer basket as a function of the output value.

3. The washing machine according to claim 2, wherein the input values are representative of the time and the change in liquid level.

4. The washing machine according to claim 1, wherein the wash cycle operation comprises at least one wash operation and at least one rinse operation.

5. The washing machine according to claim 1, wherein said liquid level sensor comprises a reservoir integrally formed with said washer tub, a pressure sensor, and a tubing coupling said reservoir to said pressure sensor.

6. The washing machine according to claim 1, wherein the change in liquid level is proportional to the predetermined initial liquid level and the load size and fabric type of the articles.

7. A method for determining a level of liquid to be supplied in a wash cycle operation of a washing machine having a washer tub and a washer basket disposed in said washer tub with articles contained therein, the method comprising the steps of:

supplying a liquid to said washer tub and said washer basket;

filling said washer tub and said washer basket with the liquid to a predetermined initial level;

measuring the time to fill said washer tub and said washer basket to the predetermined initial level and providing a signal representation thereof;

soaking the articles in said washer basket for a predetermined time;

measuring a change in the level of liquid in said washer tub and washer basket after soaking for the predetermined time and providing a signal representation thereof; and determining the level of liquid to be supplied in the wash cycle operation as a function of the time to fill to the predetermined initial level and the change in the level of liquid.

8. The method according to claim 7, wherein said step of determining the level of liquid to be supplied in the wash cycle operation comprises the steps of:

using a fuzzy rule base fired as input values from the time to fill to the predetermined initial level and the change in the level of liquid are received;

matching the rules in said fuzzy rule base to the input values; and outputting an output value representative of the level of liquid to be supplied in the wash cycle operation.

9. The method according to claim 8, further comprising the step of supplying the liquid to said washer tub and said washer basket as a function of the output value.

10. The method according to claim 7, wherein the wash cycle operation comprises at least one wash operation and at least one rinse operation.

11. The method according to claim 7, wherein the change in liquid level is proportional to the predetermined initial liquid level and the load size and fabric type of the articles.

* * * * *